United States Patent [19]

Ollinger

[11] 4,062,163

[45] Dec. 13, 1977

[54] ALIGNMENT AND STABILIZING CLIP FOR ACOUSTICAL TILE INSTALLATION

[75] Inventor: James C. Ollinger, Lancaster, Pa.

[73] Assignee: Armstrong Cork Company, Lancaster, Pa.

[21] Appl. No.: 758,004

[22] Filed: Jan. 10, 1977

[51] Int. Cl.[2] ..... E04B 5/52; E04B 1/38

[52] U.S. Cl. ..... 52/481; 52/484; 52/492; 52/496; 52/714; 85/13

[58] Field of Search ..... 52/582, 284, 354, 496, 52/714, 715, 668, 479, 481, 483, 489, 747, 492; 85/13; 403/346

[56] References Cited

U.S. PATENT DOCUMENTS

| | | | |
|---|---|---|---|
| 1,879,457 | 9/1932 | Paulsen | 52/714 |
| 2,008,192 | 7/1935 | Stubbs | 52/747 X |
| 2,326,506 | 8/1943 | Tummins | 52/714 X |
| 3,171,232 | 3/1965 | Gretter | 52/496 X |
| 3,861,105 | 1/1975 | Starks | 52/484 |

FOREIGN PATENT DOCUMENTS

| | | | |
|---|---|---|---|
| 1,417,439 | 1965 | France | 52/309.4 |

*Primary Examiner*—J. Karl Bell

[57] ABSTRACT

An elongated metal clip, substantially L-shaped in cross section, is provided for joining the tiles in a starting row of a suspended ceiling system in edge-aligned relationship and stabilizing them against possible subsequent misalignment. The base of the clip is adapted to be placed on the top surface of a tile adjacent its edge portion. The integral flange on the clip extends downwardly over the edge of the tile and has prongs extending from each side adapted to penetrate the edge portion of this tile and the adjoining edge portion of an adjacent tile. The clip is installed so that one end is in contact with a wall-mounted support member for the tile to further assure stabilization against misalignment thereof. The design of the clip is such that, if it is dropped or placed on a surface, no potentially dangerous upstanding projections are present.

3 Claims, 3 Drawing Figures

16
17
25
23
26
1
2
5
4
5
24
21
22
3
27
20
19
18
19
20

ALIGNMENT AND STABILIZING CLIP FOR ACOUSTICAL TILE INSTALLATION

CROSS-REFERENCE TO RELATED APPLICATIONS

This application is an improvement over copending U.S. application Ser. No. 758,003, filed Jan. 10, 1977, in the names of David F. Nicklaus, James C. Ollinger, and Thomas M. Petrie, and entitled Clip For Joining And Stabilizing Aligned Acoustical Tile.

BACKGROUND OF THE INVENTION

1. Field of the Invention

This invention relates to a metal clip for use in installing the starting row of tiles in a ceiling system. In particular, the invention relates to a metal clip which is L-shaped in cross section; has a base which overlies a tile surface at the edge thereof; and has a flange with prongs extending outwardly from each side to penetrate the edge portions of adjacent tiles when placed therebetween. The clip, when in position, is adapted to extend along the tile edge into contact with a wall-mounted support member to stabilize the tiles and keep them from becoming misaligned during installation of additional tiles.

DESCRIPTION OF THE PRIOR ART

It is known to provide concealed ceiling suspension systems wherein the supporting members for the acoustical tile are not visible when viewed from below. In such a system, as described in U.S. Pat. No. 3,736,012, the main runner system of the ceiling suspension system is fastened by wires to the overlying ceiling structure of the building. The main runner structures extend all parallel to each other and are appropriately spaced apart. Extending perpendicular to the main runner structure, there is provided a series of cross members upon which the actual ceiling panels or tile are supported. The support flanges for the cross members fit in kerf structures in the ceiling panels or tile and support these panels or tile in position in the ceiling region. For simplicity of construction, the vertical web of the cross member is provided with a substantially T-shaped groove into which may be slid the structure of the main runner. Thus, the main runner is able to carry the cross member, and the cross member may be adjusted to any location along the main runner.

In the past, a variety of concealed clips have been developed for the installation of wallboard ceiling panels and the like. Examples of clips of this type which have prongs adapted to penetrate the vertical edge portion of wall and ceiling panels or the like are shown by the following patents:

U.S. Pat. No. 2,109,448 relates to a clip for installing wall and ceiling panels. The clip is of integral formation, being stamped from a single sheet of metal and has a base on one end adapted to be nailed to a joint or other support and has an offset triangularly-shaped prong on the other end adapted to penetrate the edge of a board. A plurality of clips are used alternately facing in opposite directions in the mounting of adjacent boards.

U.S. Pat. No. 2,129,975 relates to a fastening element for acoustical tile comprising a clip of sheet metal having bases adapted to slide in and be supported by channel members fastened to a surface to be covered. The clips also have oppositely directed prongs adapted to be force into the vertical edges of adjacent tiles.

U.S. Pat. No. 3,308,590 relates to a concealed removable panel fastener and comprises a base adapted to be fastened to a substrate; leg sections extending beyond the shoulder in the same plane as the base; a shoulder extending vertically from one side of the base; and sharp points extending outwardly from the top of the shoulder in a plane parallel to the plane of the legs. In use, the base and leg sections are positioned on the substrate or joist, and the sharp points penetrate the edge of a panel to be mounted thereon.

U.S. Pat. No. 2,066,813 relates to a fastening device for wallboards, tiles, and the like, and includes a base adapted to be fastened to a supporting joist or the like; a web portion disposed at an angle to the base; and, prongs projecting obliquely from opposite sides of the web, adapted respectively to penetrate adjacent edges of neighboring boards.

The disclosures of the prior art offer no solution to the problem, as previously outlined, of fastening and stabilizing the tiles in the starting row of a ceiling structure against the possibility of misalignment thereof during the subsequent installation of other tile. The clip of the previously mentioned copending application Ser. No. 758,003 satisfactorily performs its intended function of joining and stabilizing the tiles in a starting row of ceiling tiles. However, use of the clip requires that adjacent tiles in the row be in place and edge-aligned prior to installation of the clip. Since the clips are installed on the back of the tile, from below, and the working space above the tile is normally limited, it is required that the clip be quite long in order that one end thereof may contact a wall-mounted tile support member for alignment and stabilization purposes, and that the prongs extend downwardly from each side of the base of the clip to penetrate the back surface edge portion of adjacent tiles to join them. Often, prior to use, these clips may fall or be placed on a surface with the prongs extending upwardly, thus presenting a safety hazard. None of the prior clips, by virtue of their design, function to provide the ease of installation; the economy of material required; and the safety element incorporated in the clip of Applicant's invention. The safety feature is very important in view of the fact that many of the clips will be used on do-it-yourself installation jobs and may be dropped or scattered around on the floor or other surface and ultimately may be stepped or sat upon.

SUMMARY OF THE INVENTION

This invention relates to a metal clip for joining acoustical tiles in the starting row of a suspended acoustical ceiling structure and holding them in edge-aligned relationship with each other by joining adjacent tiles at their opposed edge portions and extending along the edge of the tile into contact with a support structure therefor. The clip is substantially L-shaped in cross section and comprises a base which is adapted to overlie a surface portion of a tile adjacent its edge, and extend therealong into abutting relationship with a support means for the tile. The clip is formed from a single piece of sheet metal and includes a flange which is integral with the base and extends therefrom in a plane perpendicular to that of the base. Prongs are provided on the flange and extend outwardly from the sides thereof in opposite directions and in planes perpendicular to the plane of the flange and the plane of the base. The prongs are adapted to penetrate opposing edge portions of adjacent tiles and secure them against relative movement. The width and mass of the base, being greater than that of the flange, causes the clip, if dropped or placed on a surface, to always tilt in the direction of the base. In one position, the inwardly projecting prongs are covered by the base, and since the base of the outwardly projecting prongs starts on the flange at a point well below the bend between the flange and base, and the tops of the prongs taper downwardly, there are no potentially injurious, sharp upwardly directed projections. The other position that the clip may assume, if dropped or placed on a surface, is one where the base is flat on the surface and the flange extends upwardly perpendicular thereto. Again though, since the prongs extend inwardly and outwardly in sidewise directions, there are no sharp, potentially injurious projections facing upwardly. It is, therefore, apparent that the clip of this invention not only incorporates a safety feature not found in the prior art, but additionally provides a means for joining tiles in the starting row of a ceiling system in edgealigned relationship with each other and maintaining such relationship by stabilizing the tile against possible misalignment during the subsequent installation of additional tile. The clip also provides an easy and convenient concealed means for accomplishing the foregoing.

DESCRIPTION OF THE PREFERRED EMBODIMENT

Figure 1:
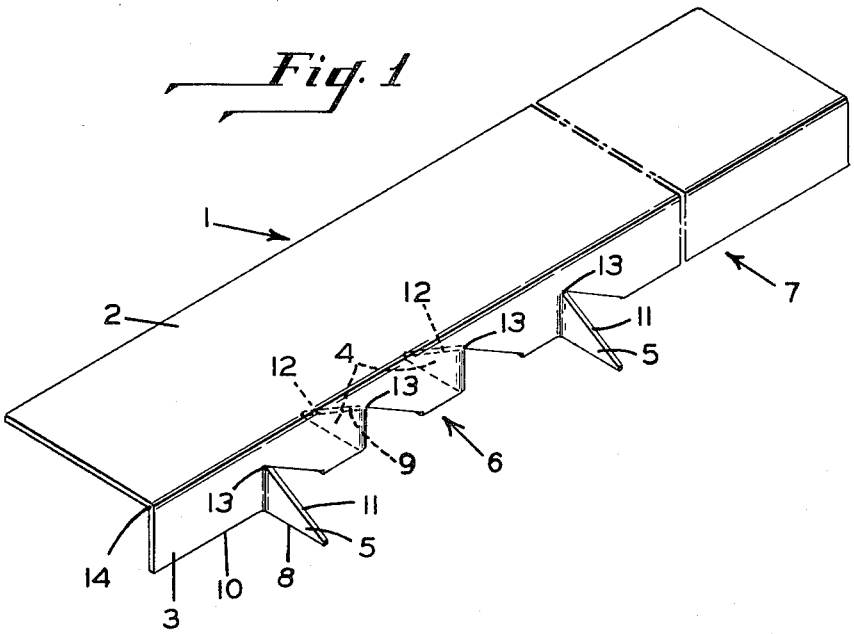
FIG. 1 is an isometric view showing the clip of this invention.

Referring to the drawings, there is shown in FIG. 1 a clip 1, which is preferably formed from a single, rectangularly-shaped flat piece of sheet metal into a shape which is generally L-shaped in cross section. The clip has a rectangularly-shaped top or base portion 2 and a perpendicular integral flange 3. Sharp inwardly and outwardly extending prongs 4 and 5, respectively, are formed on one portion 6 of flange 3 and are adapted to penetrate opposing edge portions of adjacent tiles to join and aid in securing them against relative movement. The remaining portion 7 of flange 3 is preferably devoid of prongs because in use, many times it is desirable to decrease the overall length of the clip, depending on the dimensions of the tile to which the clip is applied. In view of this, it is not necessary nor desirable to form prongs on the portion 7 of flange 3, as will become more evident from the later explanation included herein. Prongs 4 and 5 are struck inwardly and outwardly, respectively, from flange 3 in a known manner. As shown in FIG. 1, prongs 4 and 5 extend from flange 3 in opposite directions and in vertical planes perpendicular to the flange 3 and base 2 and have bottom edge portions 8 and 9 which lie in the same plane as that of the bottom edge 10 of flange 3. The top edge portions 11 and 12 of prongs 4 and 5, respectively, lie in planes which are angularly disposed to that of the bottom edges 8 and 9 of the prongs.

One of the features of the clip of this invention is that, due to its design, it will not, if dropped or left lying around, present any sharp, upwardly extending, potentially injurious projections. This is an important feature in view of the fact that such clips may be used in many do-it-yourself projects where, many times, less than adequate safety precautions are exercised. As shown in FIG. 1, the design features of the clip 1 which contribute to its safety potential are, first, the prongs 4 and 5 project sidewise, inwardly and outwardly, from each side of the vertical flange 3, which means that there are no upstanding, sharp projections; secondly, since the dimensions and mass of the bass are greater than those of the flange, the clip, if dropped onto, or placed on a substantially flat surface, will come to rest in one of two positions. In the first position, the longitudinal edges of both the base and flange would be in contact with the surface. In this position, the inwardly projecting prongs would be underneath the clip body, and the outwardly projecting prongs would be below the edge of the clip where it is bent to form the flange, since this would be the most elevated part of the clip in this position. It will also be noted that the angularly disposed edges 11 and 12 of prongs 4 and 5 join the flange 3 at points 13, which are spaced downwardly from the bend line 14 between the flange 3 and the base 2; and since the top edge of the prongs taper downwardly from the side surfaces of the flange, there are no potentially injurious, upwardly directed projections.

The other position which the clip might assume if dropped or placed on a substantially flat surface is one where the base is flat on the surface (due to the greater mass of the base) and the flange extends upwardly perpendicular thereto. Again, though, since the prongs project in a sidewise direction from the flange, there are no sharp, potentially injurious projections facing upwardly.

Figure 2:
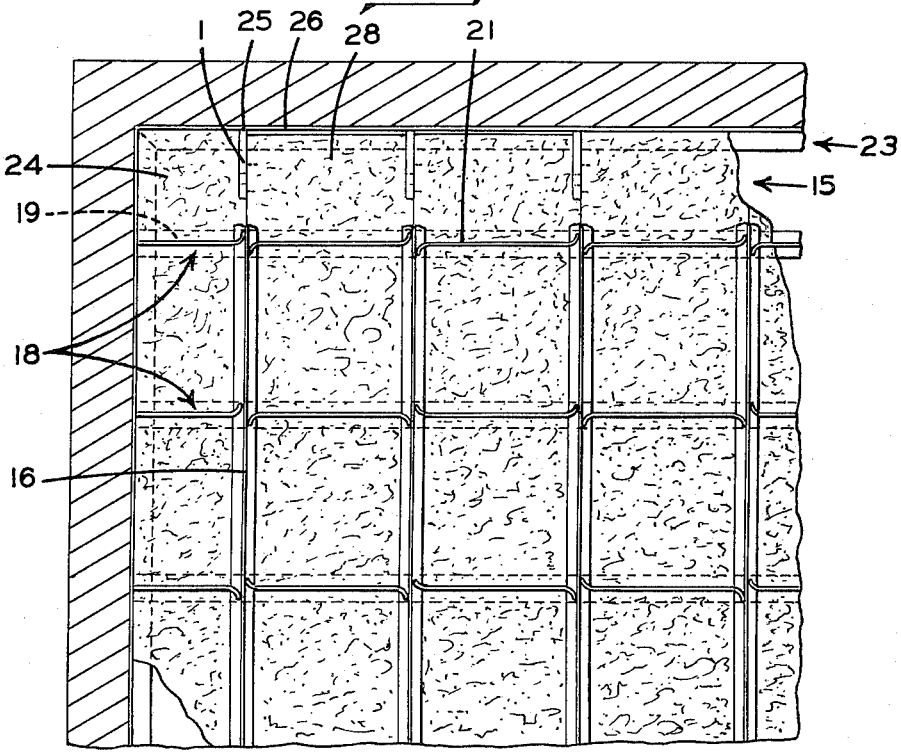
FIG. 2 is a plan view looking down on the back of a portion of an assembled ceiling struture, showing the clip of this invention as it is used in the installation of the first row of tile therein.

In FIG. 2 of the drawings there is shown a plan view, looking down from above, of a portion of an acoustical ceiling wherein the tiles are in their installed position, and the clips 1 of this invention are installed in the starting row 15 in the location where they would be placed to join the tile and stabilize them against misalignment during installation of subsequently installed tiles. The following description will be more readily understood by the simultaneous reference to FIGS. 2 and 3 of the drawings. It will be understood that the clip of this invention may be used in connection with tiles having edge configurations other than the ones shown and described herein, which are used merely as one non-limiting example.

Figure 3:
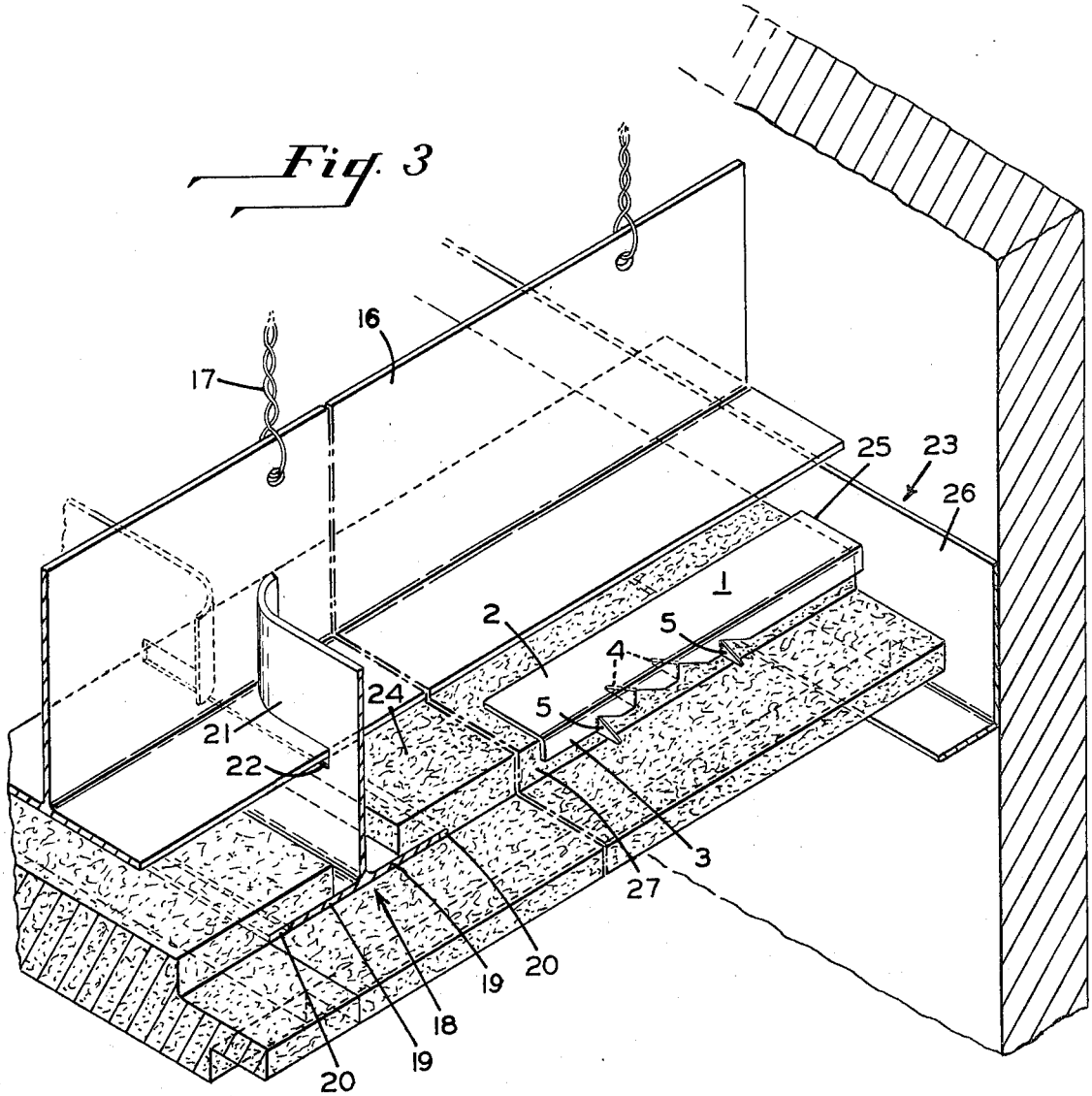
FIG. 3 is an enlarged isometric view of a portion of suspended ceiling structure, partially broken away and partially sectioned, and showing one of the clips of this invention in position on a tile in the first row of tiles in the ceiling structure.

As indicated in FIG. 3 of the drawings, one type of suspended ceiling with which the clip of this invention may be used includes main runner structures 16, which may be suspended by support means such as 17 from an overlying ceiling struture of the building (not shown). The main runner structures 16 extend all parallel to each other at an appropriate spacing apart. Extending perpendicular to the main runner structure there is normally provided a series of cross members 18 upon which the actual ceiling panels or tile are supported. The support flanges 19 for the cross members 18 fit into kerf structures 20 in the ceiling panels or tile and support these panels or tile in position in the ceiling region. The vertical web 21 of the cross member 18 is provided with a substantially T-shaped groove 22 into which may be slid the structure of a main runner 16. Thus, the main runner 16 is able to carry the cross member 18, and the cross member 18 may be adjusted to any location along the main runner 16. A structure of this type is shown and described in U.S. Pat. No. 3,736,012 and as noted therein, the structure is extremely simple to put together, does not require any complicated tooling or adjusting of the runner structure to fasten it together.

As previously noted, the clip of this invention is used in connection with the starting row 15 of tile in a ceiling system such as shown in FIGS. 2 and 3 of the drawings. As shown therein, one edge of the starting row 15 of tile is supported adjacent a wall of the room by means of a substantially L-shaped wall molding member 23 which is normally attached around the perimeter of the wall at the appropriate location by known means.

Because most rooms vary in size and because most acoustical tiles are manufactured in units of the same size, normally the border tiles, which include starting row 15, must be cut to the proper dimensions to fill the space between the wall and the first and last rows of full sized tile. Another reason the tiles must be cut is because of the fact that very few walls are perfectly straight and frequently bow either in or out. Further, most walls will be slightly crooked since wall studs are seldom exactly straight in line with one another. Therefore, all tiles in the first row 15 must be cut to match the contours of the starting wall as closely as possible. It has been found that due to almost inevitable inaccuracies in such cutting, there still remained a need for a simple means by which the tile could be joined together and stabilized against misalignment during the installation of subsequently installed tiles. This is the purpose served by the clip of this invention.

In installing the starting row of tile in the ceiling system, the first tile 24, after having been cut to the appropriate size, is installed in the corner of the room, as shown in FIG. 2. A clip 1 is then applied to the tile in the position shown most clearly in FIG. 3 of the drawings. When so installed, the end 25 of the clip 1 is in contact with the vertical portion 26 of the wall molding member 23; the base 2 of the clip 1 lies flat on the surface of the tile 24 and the inwardly directed prongs 4 are pressed into the edge portion 27 thereof. The second tile 28 in the starting row, which, of course, will have an edge configuration which will mate with the edge configuration of the first tile 24, is then installed by sliding the tongue thereof into contact with the prongs 5 on the flange 3 of the clip 1 on the first tile 24; aligning the edges of the tiles which are farthest from the wall; and pushing on the tile to embed the prongs 5 in the edge of the second tile 28. A cross member 18 previously installed on the main runners 16 is then slid along the runner, and the flange 19 thereon is slide into the kerf (slots) 20 in the tiles. This procedure is repeated using additional cross members which lock together until the last tile in the row is installed. The process is then repeated for installing the second row of tiles except that the clips are not used.

Thus, it can be seen that the clip of this invention provides a simple and effective concealed means of joining the tile in the starting row of a suspended ceiling system in perfect edge alignment and, additionally, it provides a sure means for stabilizing the tile against possible misalignment when installing subsequent tiles. Still further, due to its design, the clip of this invention eliminates the possibility of injury if the clips are scattered around at the job site.

What is claimed is:

1. A metal clip for joining acoustical tiles and contacting a wall-mounted support structure therefor to hold the tiles in a starting row of a suspended acoustical structure in edge-aligned relationship with each other, said clip comprising:

a. an elongated body member having a substantially rectangular base portion adapted to overlie a portion of the back surface of an acoustical tile adjacent an edge thereof;

b. a flange integral with said base and extending along the entire length of said body member from one edge only thereof in a plane perpendicular to that of the base, said flange being of lesser mass and width than the base and adapted to extend between and along opposing edges of adjacent tiles in a direction perpendicular to the wall-mounted support structure;

c. first and second prong means each comprising a pair of prongs extending from a portion of said flange adjacent the end thereof remote from the wall-mounted support member, said first and second prong means extending from said flange in opposite directions and in vertical planes perpendicular to said flange and said base and adapted to penetrate opposing edges of adjacent tiles, said first prong means being separated by said second prong means with approximately equal spacing between all prongs; and d. end means on said clip adapted to contact a vertical portion of a wall-mounted support member, said end means being devoid of prongs and being adapted to function together with said prong means to prevent movement of the tiles relative to each other and to the wall-mounted support member.

2. The clip according to claim 1, wherein said prong means all comprise portions of said flange which have been struck outwardly and inwardly, respectively, therefrom and have bottom edges which lie in the same plane as that of the bottom edge of the flange, and top edges which lie in planes angularly disposed thereto, the top edges of said prong means having their points of juncture with said flange located in downwardly spaced relationship to the point of juncture of said flange and said base.

3. An edge-aligned, joined, and stabilized starting row of tiles in a suspended ceiling system, comprising in combination, a plurality of ceiling tiles, substantially L-shaped means mounted on a wall for supporting the tiles at their edge portions which are adjacent the wall, movable means having a cross sectional shape substantially in the form of an inverted T for supporting the edges of said tiles which are opposite those adjacent the wall, clip means mounted on said tile and extending between and along adjacent opposed edge portions thereof into contact with the vertical portion of said wall-mounted support means, said clip means comprising an elongated body member having a substantially rectangular base portion positioned on the surface of the tile adjacent an edge portion thereof which opposes an adjacent tile and, a flange integral with said base portion and extending along the entire length of said body member from one edge only thereof in a plane perpendicular to that of the base, said flange being of lesser mass and width than the base and extending between opposed edge portions of the tile, first and second prong means each comprising a pair of prongs extending from a portion of said flange adjacent the end thereof remote from the wall-mounted support means, the first pair of prongs being separated by the second pair of prongs with approximately equal spacing between all prongs, said first and second prong means extending from said flange in opposite directions and in vertical planes perpendicular to said flange and said base into opposed edge portions of adjacent tiles, the support-contacting end portion of said flange being devoid of prongs.

* * * * *